US006175313B1

(12) United States Patent
Berezovsky

(10) Patent No.: US 6,175,313 B1
(45) Date of Patent: Jan. 16, 2001

(54) ATTACHMENT TO TRAFFIC LIGHT APPARATUS FOR VISUAL INDICATION OF TRAFFIC LIGHT DURATION

(76) Inventor: Yefim Berezovsky, 1374 Cherrywood Sq., San Jose, CA (US) 95117

( * ) Notice: Under 35 U.S.C. 154(b), the term of this patent shall be extended for 0 days.

(21) Appl. No.: 09/300,875

(22) Filed: Apr. 28, 1999

(51) Int. Cl.[7] ..... G08G 1/096
(52) U.S. Cl. ..... 340/929; 340/907
(58) Field of Search ..... 340/929, 907, 340/944, 908, 930

(56) References Cited

U.S. PATENT DOCUMENTS

| | | | | |
|---|---|---|---|---|
| 2,480,290 | * | 8/1949 | Fein | 340/907 |
| 2,842,627 | * | 7/1958 | Wagner | 340/907 |
| 3,234,506 | * | 2/1966 | Hines | 340/907 |
| 3,320,585 | * | 5/1967 | Hines | 340/907 |
| 3,408,623 | * | 10/1968 | Wagner | 340/907 |
| 3,529,287 | * | 9/1970 | Southerland | 340/907 |
| 4,167,001 | * | 9/1979 | Gilmore | 340/907 |
| 4,214,168 | * | 7/1980 | Kulka | 340/907 |
| 4,255,737 | * | 3/1981 | Casteel | 340/907 |
| 4,590,455 | * | 5/1986 | Fritzinger | 340/907 |
| 5,150,116 | * | 9/1992 | West | 340/907 |
| 5,519,390 | * | 5/1996 | Casini | 340/929 |
| 5,726,648 | * | 3/1998 | Soon | 340/929 |
| 5,838,260 | * | 11/1998 | Liu | 340/907 |
| 5,892,461 | * | 4/1999 | Dokko | 340/907 |
| 6,054,932 | * | 4/2000 | Gartner et al. | 340/907 |
| 6,072,407 | * | 6/2000 | Shin | 340/907 |
| 6,087,962 | * | 7/2000 | Rojas | 340/907 |

* cited by examiner

*Primary Examiner*—Nina Tong

(57) ABSTRACT

The device of the invention comprises an attachment to a conventional traffic light and is connected to its side wall for visually indicating the duration of the time remaining till switching of the current green, yellow, or red light in proportion to the dimension of the illuminated portion of the indicator. In accordance with one embodiment, the device is made in the form of a housing with a rotating drum which is divided into three sections by nontransparent partitions, each containing an individual lamp. The cylindrical surface which defines the periphery of each section of the drum has a transparent portion in the form of a wedge. When the drum rotates, the lit sector is shown in the window of the device so that during rotation of the drum, the dimensions of the lit portion of the drum shown through the window decrease proportionally to the remaining part of the current traffic light signal. Other embodiments have visual displays in the form of a plurality of gas-discharge lamps arranged side by side and switched on and off in a predetermine sequence, in the form of serpentine lamps of triangular configuration, in the form of vertical rectangular stripes of variable width, etc.

31 Claims, 14 Drawing Sheets

ATTACHMENT TO TRAFFIC LIGHT APPARATUS FOR VISUAL INDICATION OF TRAFFIC LIGHT DURATION

FIELD OF THE INVENTION

The present invention relates to traffic control devices, in particular, to an attachment to a traffic light apparatus for visual indication of traffic light duration.

BACKGROUND OF THE INVENTION

It has been known heretofore to incorporate into a traffic light various means for indicating the time left for illumination of a traffic light signal of one color before switching to a traffic light signal of another color.

For example, U.S. Pat. No. 4,255,737 issued in 1981 to R. Casteel teaches a traffic light apparatus that has a four sided housing, each side of which contains red and green areas that can be illuminated. Furthermore, each side contains a rotating semicircular mask which simultaneously and progressively covers one portion of one of the colored areas and uncovers a portion of the other colored area until the illumination of the traffic light is changed thereby causing a change in traffic flow. The rotation of the masks together with the actuation of the various lights is controlled from a common ring gear disposed within the housing and driven by a single motor. A disadvantage of this device is that it incorporates the traffic light covering/uncovering means directly into the traffic light apparatus. In other words, for introducing such a device into practice, it would be required to replace all existing conventional traffic lights, which is not only expensive but may increase the occurrence of accidents because of confusion caused by new appearance of the traffic lights. Another disadvantage of the aforementioned traffic light apparatus is that it has a complicated mechanical construction with a plurality of interconnected moving parts. These parts operate synchronously and simultaneously in four opposite directions. Traffic light apparatuses of this type are intended to be suspended from a console or another type support above the center of the intersection. However, in a majority of cases traffic lights of such types have been replaced by apparatuses installed on the corners of the street crossings and having signals facing only the oncoming traffic. Therefore the aforementioned device of U.S. Pat. No. 4,255,737 may find only an extremely limited practical application. Furthermore, this apparatus is not applicable to intersections which require different traffic signals for vehicles going in mutually opposite directions, e.g., a red light in one direction and a left turn/green light for the vehicle going in the opposite direction. It would be very difficult to adjust and change the mode of operation in the above-described apparatus.

U.S. Pat. No. 4,590,455 issued in 1986 to G. Fritzinger teaches a traffic control system that has green and/or red signal lights blinked momentarily at a predetermined interval before the direction of traffic is changed. A marker is placed along the roadway at a normal distance of travel within the timing of the blink signal to enable motorists to gauge their driving to save gasoline and achieve greater safety solely by noting their location relative to the marker when the blink signal occurs. Further taught is the use of the traffic signaling system in connection with a semi-actuated controller that has a synchronizer providing a background cycle. The timing of the blink signal and the yellow caution signal is obtained from the synchronizer. A disadvantage of this device is that blinking of the green signal may cause confusion, whereas blinking of the red signal is already equivalent to a stop signal and may not be understood as an indicator of the approaching switch in the traffic direction. Furthermore, an addition of a marker on the road at the approach to the traffic light may distract the driver's attention.

U.S. Pat. No. 5,726,648 issued in 1998 to M. Soon describes a time indicating traffic light that includes a vertically-oriented and rectangular-parallelepiped-shaped housing, a circular-shaped "stop" indicator light, a circular-shaped "caution" indicator light, seven rectangular-shaped "go" indicator lights, and a time indicating display. The circular-shaped "stop" indicator light, the circular-shaped "caution" indicator light, and the seven rectangular-shaped "go" indicator lights are disposed in the vertically-oriented and rectangular-parallelepiped-shaped housing. The seven rectangular-shaped "go" indicator lights have a pair of parallel, elongated, spaced-apart, vertically-oriented, and rectangular-shaped "go" indicator lights, and five adjacent, slightly vertically spaced-apart, horizontally-oriented, and rectangular-shaped "go" lights. The five adjacent, slightly vertically spaced-apart, horizontally-oriented, and rectangular-shaped "go" lights extinguish progressively upwardly towards the circular-shaped "caution" indicator light at a predetermined rate determined by a timer while the pair of parallel, elongated, spaced-apart, vertically-oriented, and rectangular-shaped "go" indicator lights remain illuminated when at least one light of the five adjacent, slightly vertically spaced-apart, horizontally-oriented, and rectangular-shaped "go" lights is illuminated. The time indicating display is disposed on the vertically-oriented and rectangular-parallelepiped-shaped housing and provides a visible display of the time of illumination of the seven rectangular-shaped "go" indicator lights, so that an approaching vehicle can determine when the circular-shaped "caution" indicator light will be illuminated by dividing the time of illumination on the time indicating display by the number of lights of the five adjacent, slightly vertically spaced-apart, horizontally-oriented, and rectangular-shaped "go" lights extinguished and thereby prevent sudden acceleration followed by a sudden stop.

A disadvantage of this timer indicating traffic light consists in that it is based on an entirely new conception and would require replacement of all existing traffic light units. Another disadvantage is that the device has a rather complicated construction, and therefore is expensive to manufacture. A provision of several different rectangular-shaped "go" indicator lights would require an essential increase in the overall dimensions of the traffic light assembly, as it would be necessary to make each "go" indicator light and the digital indicator visible from a far distance. A driver may need time for obtaining, processing the information indicated by the complicated traffic light system, and for making a decision. All this has to be done immediately, which may not be feasible for an elderly people whose driving ability would be limited.

OBJECTS OF THE INVENTION

It is an object of the present invention to provide a simple, reliable, clearly seen, clearly understandable visual traffic light duration indicator that can be attached to any existing traffic light assembly or installed close to it without necessity of essentially changing its construction. Another object is to provide a visual traffic light duration indicator which does not cause confusion, inexpensive to manufacture, does not limit driving ability, and does not distract a driver's attention, can be use in conjunction with traffic light apparatuses of various types and designs, can be easily adjusted, and is synchronized with switching of the traffic light signals from a traffic controller that controls operations of traffic lights at several neighboring intersections.

SUMMARY OF THE INVENTION

The device of the invention comprises an attachment to a conventional traffic light and is connected to its side wall for visually indicating the duration of the time remaining till switching of the current green, yellow, or red light in proportion to the dimension of the illuminated portion of the indicator. In accordance with one embodiment, the device is made in the form of a housing with a rotating drum which is divided into three sections by nontransparent partitions, each containing an individual lamp. The cylindrical surface which defines the periphery of each section of the drum has a transparent portion in the form of a wedge. When the drum rotates, the lit sector is shown in the window of the device so that during rotation of the drum, the dimensions of the lit portion of the drum shown through the window decrease proportionally to the remaining part of the current traffic light signal. Other embodiments have visual displays in the form of a plurality of gas-discharge lamps arranged side by side and switched on and off in a predetermine sequence, in the form of serpentine lamps of triangular configuration, in the form of vertical rectangular stripes of variable width, etc.

DETAILED DESCRIPTION OF THE INVENTION

Figure 1A:
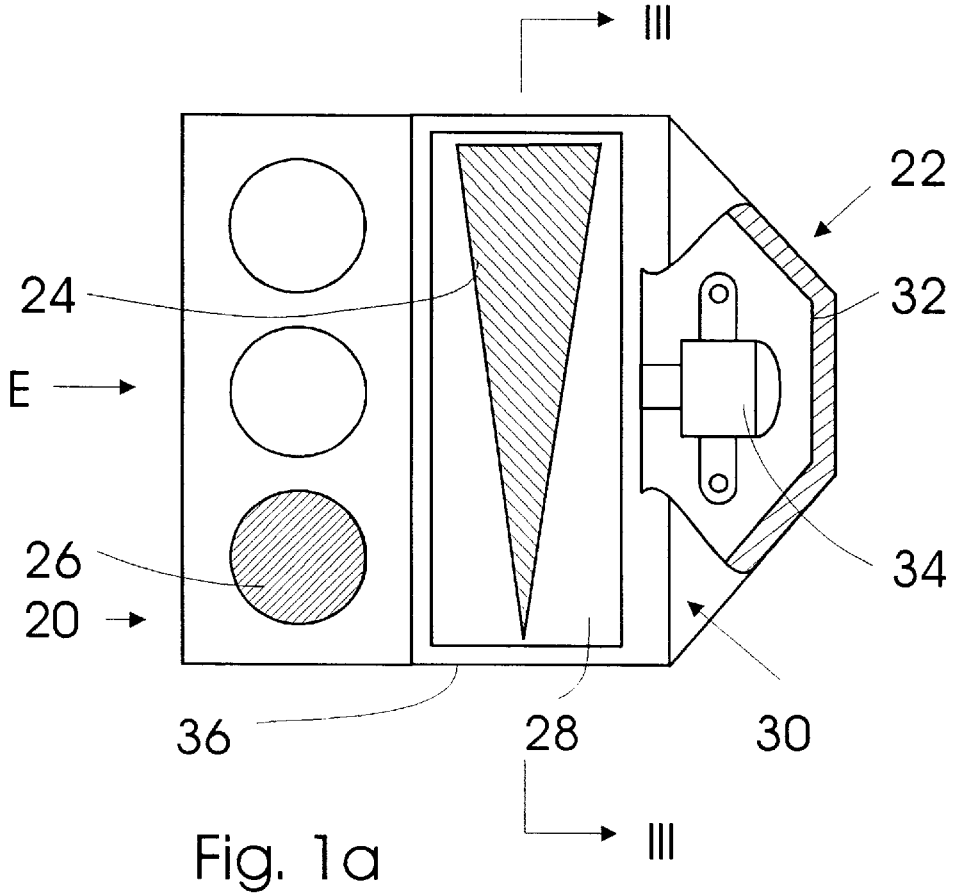
FIG. 1A is a front view of a conventional traffic light equipped with a visual traffic light duration attachment shown at the moment of switching, e.g., from "red" to "green"; the green duration indicator is illuminated.

In order to understand the principle of the invention, it would be expedient first to consider asequential operation of the device of the invention between two traffic lights switching signals. FIG. 1A is a front view of a conventional traffic light apparatus 20 equipped with a visual traffic light duration attachment 22 shown in the moment of switching, e.g., from "red" to "green"; the green duration indicator 24 which is made in the form of a transparent wedge is illuminated. In FIG. 1A, green traffic light signal 26, which currently is lit, is shown by a hatched circle in the lower part of the traffic light apparatus 20. The traffic light duration indicator 24 has the shape of a wedge formed on the peripheral cylindrical surface 28 of a drum 30 rotationally installed inside a housing 32 of attachment 22. Drum 30 is rotated by means of an electric motor 34 installed inside housing 32. In the position of FIG. 1A, the wedge-like portion 24 is shown in an open window 36 of the housing 32 in its complete form, the projection of which in the window 36 looks like a complete triangle. FIG. 1A shows a condition just after switching of the traffic light signal 26 from red to green.

Figure 1B:
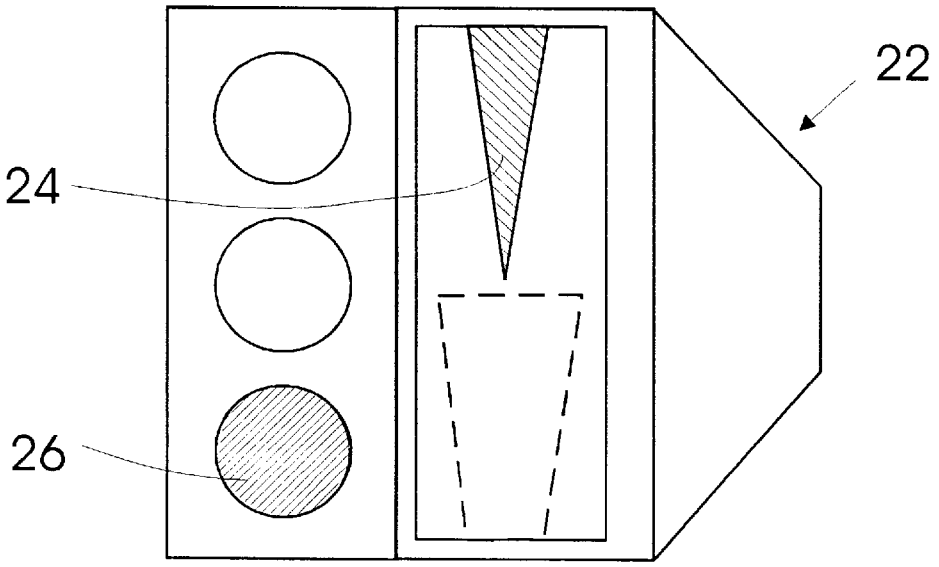
FIG. 1B is the same view as in FIG. 1A, illustrating the visual traffic light duration indicator in the intermediate moment of the "green light" time; "; the green duration indicator is illuminated.

FIG. 1B is the same view as in FIG. 1A, illustrating the visual traffic light duration indicator 24 in the intermediate moment of the "green light" time. After rotation of the drum 30 for a certain angle, the green duration indicator 24 and the green traffic light signal 26 remain illuminated.

Figure 1C:
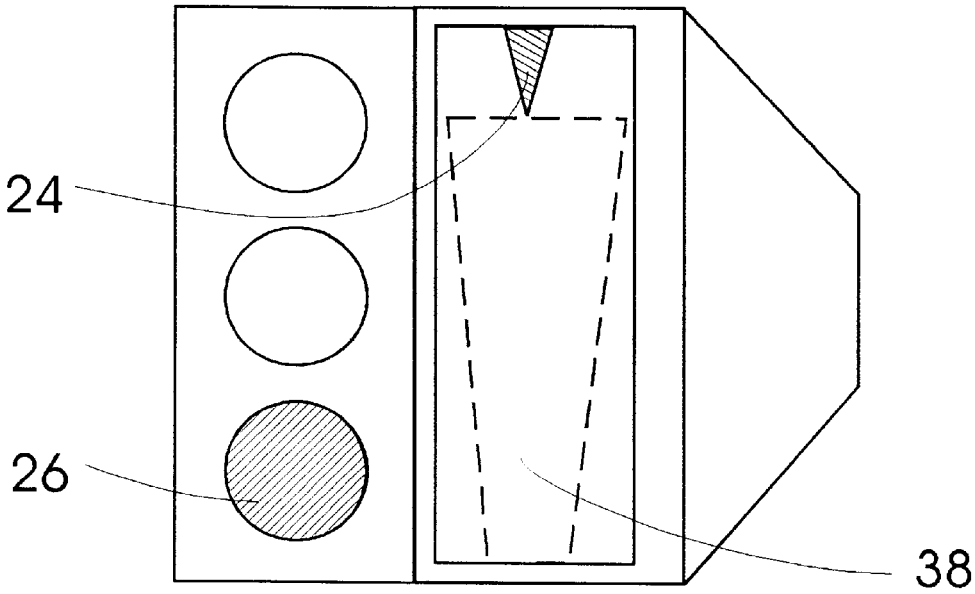
FIG. 1C is the same view as in FIG. 1A, illustrating the visual traffic light duration indicator at the moment when the green light is still "ON", the yellow is approaching, but the visual "yellow" is not yet illuminated.

FIG. 1C is the same view as in FIG. 1A, illustrating the visual traffic light duration indicator 24 at the moment when the green light signal 26 is still "ON", a yellow wedge 38 is approaching, but the visual "yellow" is not yet lit. A small fraction of green wedge 24 is still seen through the window and is still illuminated.

Figure 1D:
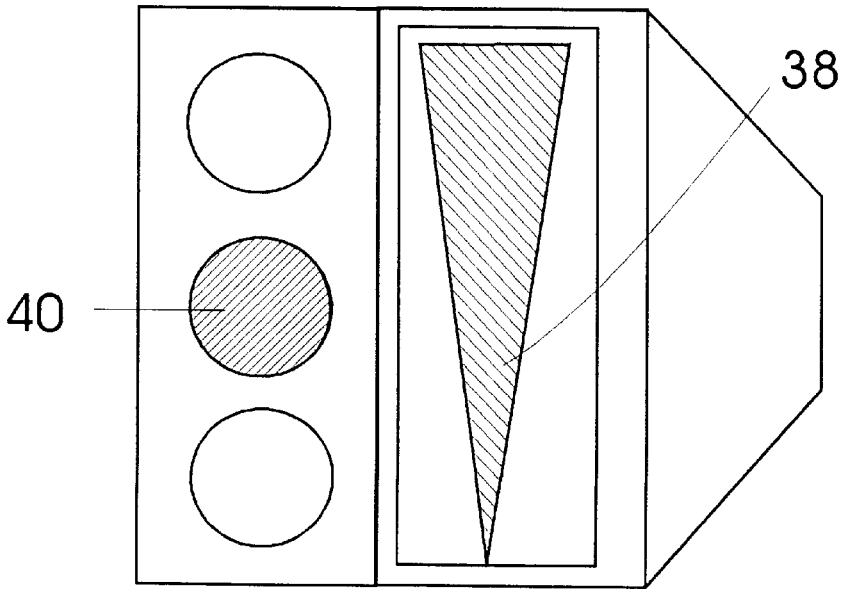
FIG. 1D is the same view as in FIG. 1A, illustrating the visual traffic light duration indicator at the moment when the yellow traffic light has just been switched on, and the visual "yellow" indicator is illuminated.

FIG. 1D is the same view as in FIG. 1A, illustrating the yellow visual traffic light duration indicator 38 at the moment when the yellow traffic light 40 has just been switched on, and the visual "yellow" wedge 38 is seen in the form of a complete triangle and is illuminated.

Figure 2:
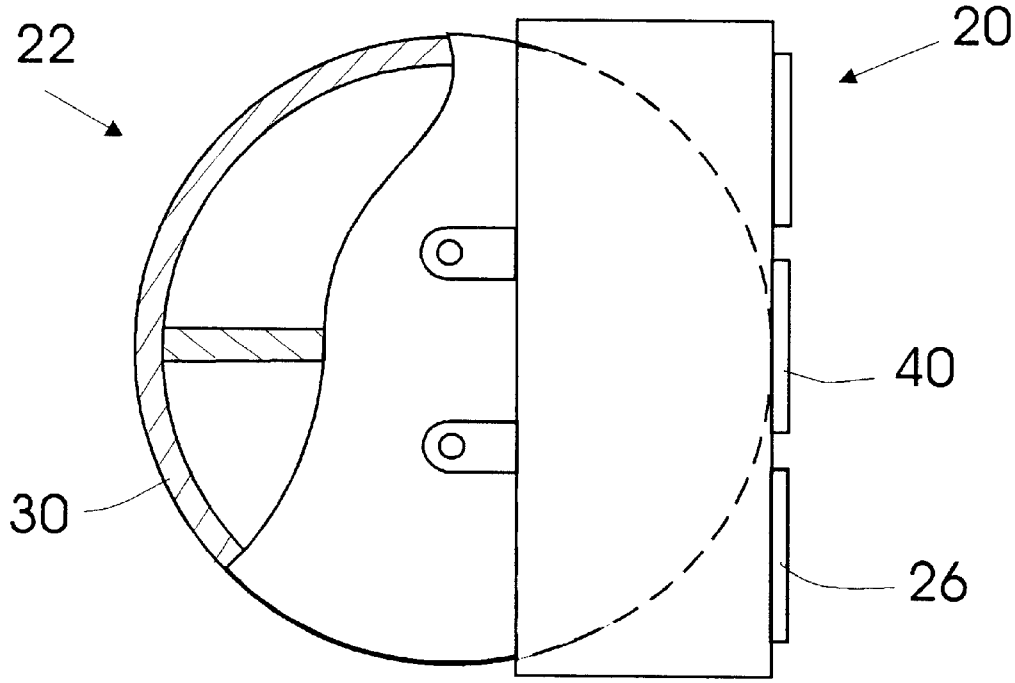
FIG. 2 is a side view in the direction of arrow E in FIG. 1A illustrating position of a rotating drum with color visual indicator elements with respect to the traffic light apparatus.

FIG. 2 is a side view in the direction of arrow E in FIG. 1A illustrating position of the attachment 22 of the invention and, in particular of the rotating drum 30, with respect to the traffic light apparatus 20.

Figure 3:
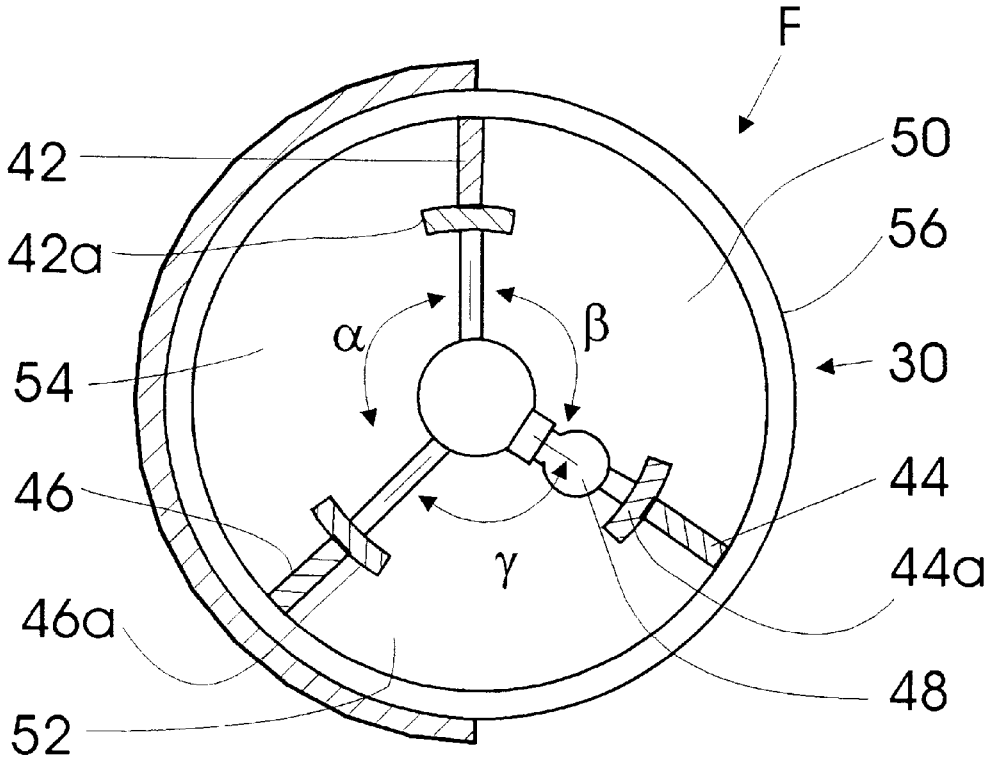
FIG. 3 is a sectional view along line III—III in FIG. 1A illustrating the arrangement of nontransparent partitions inside the rotating drum in an embodiment with a single lamp.
Figure 4:
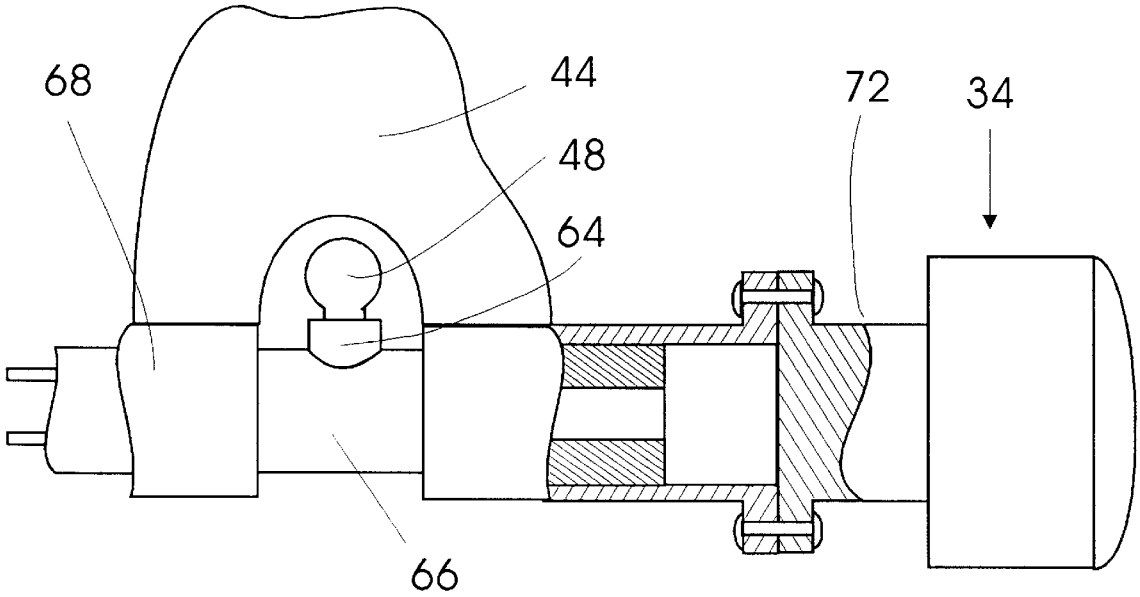
FIG. 4 is a fragmental view in the direction of arrow F of FIG. 3 illustrating mutual positions of moving and stationary parts in the central part of the drum.

FIGS. 3, 4—Embodiment of the Attachment of the Invention with a Single Stationary Lamp FIG. 3 is a sectional view along line III—III in FIG. 1A illustrating the arrangement of nontransparent partitions 42, 44, and 46 inside the rotating drum 30 in an embodiment with a single lamp 48. It can be seen from FIG. 3 that nontransparent partitions 42, 44, and 46 divide the interior of rotating drum 30 into three angular sectors 50, 52, and 54. Each sector is defined by a pair of adjacent partitions and an appropriate portion of the cylindrical surface of drum 30. In other words, the angular sector 50, is formed between nontransparent partitions 42, 44, and a portion 56 of the cylindrical surface of the drum 30. As shown in FIG. 1A, the projection of the portion 56 of the drum surface may be seen through the window 36 of the housing 32 in the form of a lighted green triangle or a part thereof (FIGS. 1B and 1C). It is understood that each cylindrical portion on the surface of the drum 30 has a transparent triangular part of an appropriate color, i.e., green, yellow, and red. If the electric motor 34 (FIG. 1A) and hence the drum 30 rotate with a constant speed, central angles $\alpha$, $\beta$, and $\gamma$ of respective sectors 54, 50, and 52 are proportional to the duration of traffic light signals the colors of which correspond to the wedge-like transparent portions (such as wedge-like portion 24 in FIG. 1A) on the cylindrical surface of the appropriate angular sector.

FIG. 4 is a fragmental view in the direction of arrow F of FIG. 3 illustrating mutual positions of moving and stationary parts in the central part of the drum 30. It can be seen that each partition 42, 44, and 46 has an appropriate cutout 58, 60, and 62 the shape of which corresponds to the shape of lamp 48 and has dimensions slightly larger than the outer configuration of the lamp 48 so that during rotation of the drum 30 the partitions will pass beyond the lamp 48 without contact with the latter. At the end of each cutout, each partition has an appropriate shading baffle 42*a*, 44*a*, and 46*a* which shades lamp 48 during transition from one sector to another.

As shown in FIG. 4, a cartridge 64 of the lamp 48 is supported by a stationary shaft 66 which is fixed to stationary housing 32 (FIG. 1A) of the attachment 22, whereas the drum 30 (FIG. 3) with partitions 42, 44, and 46 is rotationally installed on the shaft 66 on bearing supports 68 and 70 and is connected to an output shaft 72 of electric motor 34.

FIGS. 1A–D, 3, and 4—Operation of the Device of the Invention with a Single Lamp The attachment 22 of the invention shown in FIGS. 3 and 4 operates as follows. Let us assume that the initial position corresponds to the condition shown in FIG. 1A, i.e., when the green traffic light signal has just been lit, and projection of the wedge-like portion 24 on the cylindrical surface 56 of the green sector 50 is seen as a complete triangle. As drum 30 continues its rotation from motor 34 in the direction of arrow G shown in FIG. 3, the angular sector 50 shifts in the angular direction with respect to the stationary lamp 48. The sequential stages of the rotation of this section of the drum 30 are shown in FIGS. 1B and 1C. Illumination of the green sector 50 with decrease in geometrical dimensions of the green wedge 24 continues until the lamp 58 enters another sector, i.e., yellow sector 54, and the process is repeated with the angular sector 54, until the red sector 52 is lit.

Although the embodiment of FIGS. 3 and 4 is advantageous in that it has a very simple construction and electric circuitry, resulting from the use of a stationary lamp, its disadvantage is that at a certain time of transition from one color to another underneath a respective shading baffle 42*a*, 44*a*, and 46*a*, both lighted colored triangles will be seen as dim images through the window 36 of housing 32 (FIG. 1A). This disadvantage is eliminated in an embodiment of the invention with three lamps rotating together with the drum and switched on in sequence synchronously with switching of the traffic lights.

Figure 5:
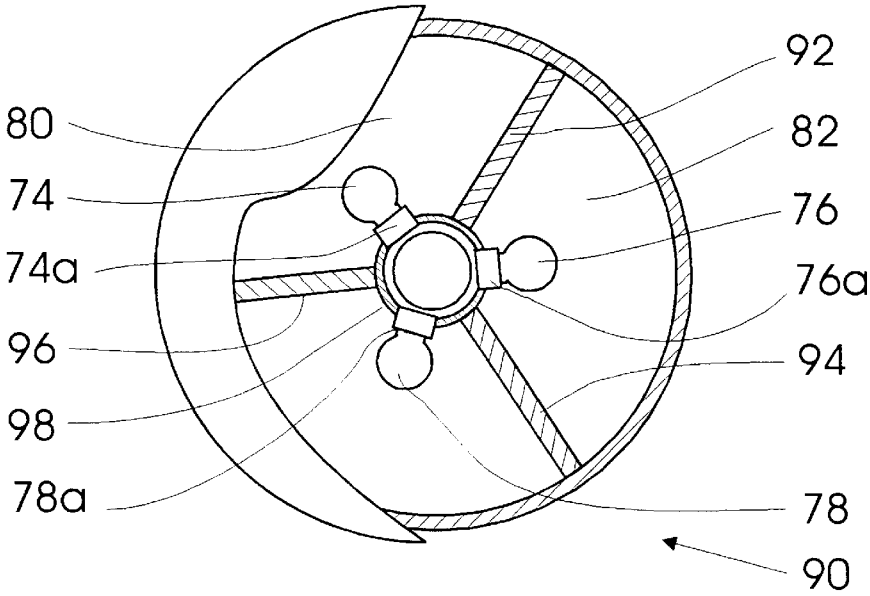
FIG. 5 is a view similar to FIG. 3 for an embodiment with three individual lamps, each for illuminating an appropriate sector of the drum.
Figure 6:
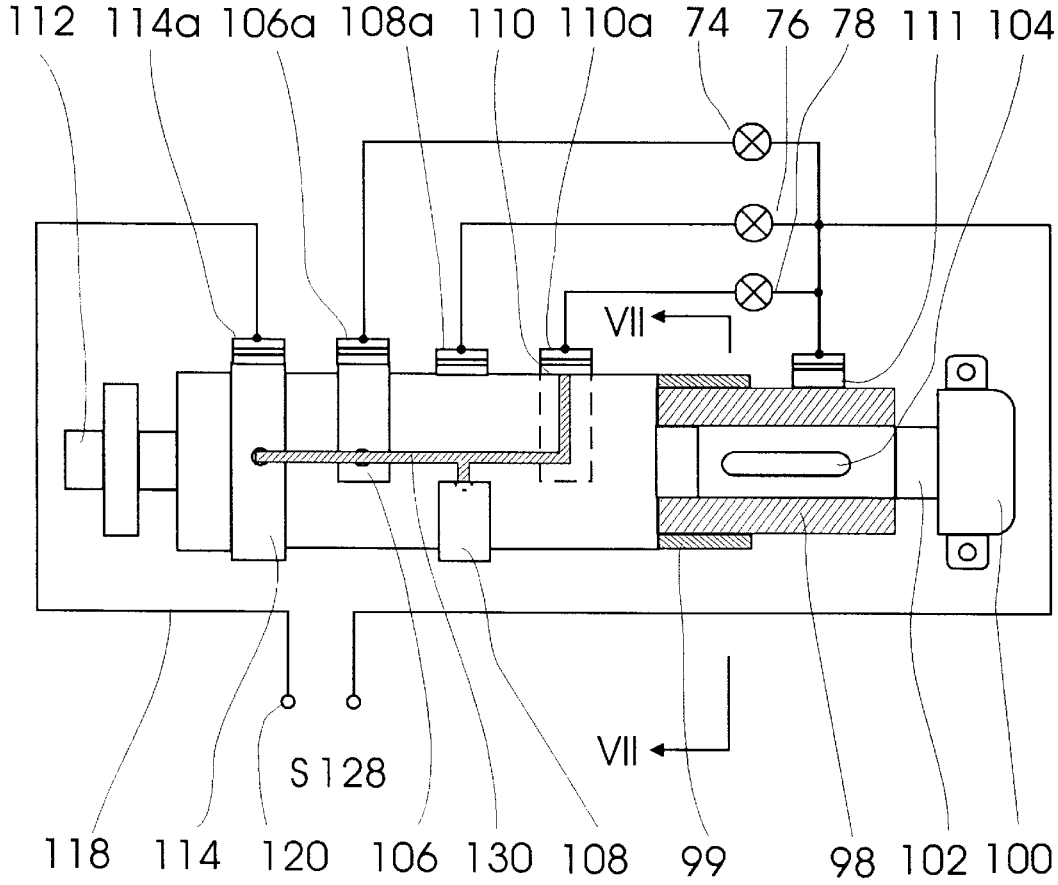
FIG. 6 is an electric diagram of the device according to the embodiment of FIG. 5 illustrating circuitry for sequential switching of individual lamps for illuminating an appropriate sector of the drum.
Figure 7:
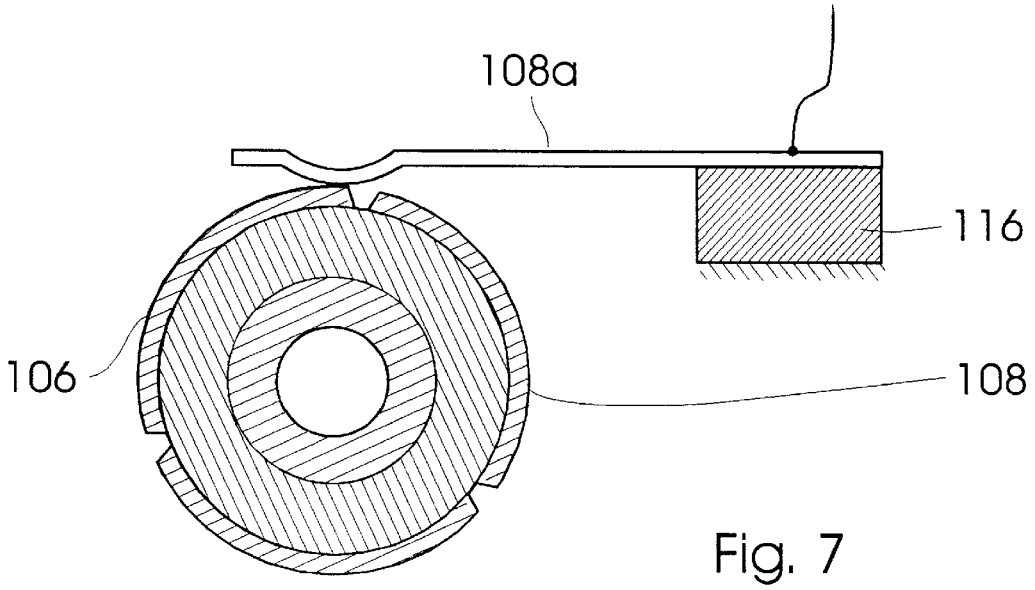
FIG. 7 is a sectional view of the hub along line VII—VII of FIG. 6.

FIGS. 5, 6, and 7—Operation of the Device of the Invention with Individual Lamps for Each Sector FIG. 5 is a view similar to FIG. 3 for an embodiment with three individual lamps 74, 76, and 78, each for lighting an appropriate sector 80, 82, and 84 of a drum 90. The drum 90 and the drum drive mechanism differ from those of FIGS. 3 and 4 in that each sector has its individual lamp and in that partitions 92, 94, and 96 between the sectors 80, 82, and 84 are continuous and do not have openings for the lamps. This is because in this embodiment lamps 74, 76, and 78 rotate together with the drum 90. For this purpose, cartridges 74*a*, 76*a*, and 78*a* of respective lamps 74, 76, and 78 are attached to a hub 98 of the rotating drum 90.

FIG. 6 is an electric diagram of the device according to the embodiment of FIG. 5 illustrating circuitry for sequential switching of the individual lamps 74, 76, and 78 for illuminating appropriate sectors 80, 82, and 84 of the drum 90. A drive motor 100 supports on its output shaft 102, e.g., by a drive key 104, hub 98 of the rotating drum 90 (FIG. 5). FIG. 7 is a sectional view of the hub along line VII—VII of FIG. 6 illustrating different angular positions of current collectors 106, 108, and 110 for individual lamps, the angular distances between the current collectors being proportional to the duration of the visual color indicators.

As shown in FIG. 6, the end of the hub 98 opposite to motor 100 is supported by a stationary shaft 112 which is attached to a stationary part of the housing (not shown) of the attachment of the invention and rotationally supports the hub 98 of the rotating drum 90 with respect to the housing of the device.

The hub 98 supports a sleeve 99 made of a nonconductive material, such as a strong plastic. Sleeve 99, in turn, supports on its surface aforementioned current collectors 106, 108, and 110 which are made of a highly conductive metal such as copper.

As shown in FIGS. 6 and 7, current collectors 106, 108, and 110, are shifted angularly and axially with respect to each other. In other words, they are shifted angularly, e.g., by an angular phase of 120° (FIG. 7) and are shifted in the axial direction of the hub 98 to a distance sufficient for non-interfering each other during the operation. A fourth element current collecting element supported by the non-conductive hub 98 of rotating drum 90 is a metal current collecting ring 114. Each current collector 114, 110, 108, and 106 is in a constant sliding contact with a corresponding spring-loaded contact 114*a*, 110*a*, 108*a*, and 106*a* connected to a brush or another current receiving element of the motor 100. Only one spring-loaded contact 108*a* and brush 116 are shown for illustrative purposes in FIG. 7.

As shown in the electric circuit of FIG. 6, current collecting ring 114 is constantly connected via a conductor 118 to one terminal 120 of the main power supply S. Each lamp 74, 76, and 78 is connected via a respective sliding contact 106*a*, 108*a*, and 110*a* and conductors 122, 124, and 126 to a fifth current collector 111 and through this current collector to the second terminal 128 of the main power supply S. Each current collector 106, 108, and 110 is connected to metal current collecting ring 114 via a current collecting bus 130.

It should be noted that in the embodiment of FIGS. 6 and 7 the electric motor 100 rotates with a constant speed, and therefore the duration of the traffic light signal depends on the angular length of the respective current collectors 106, 108, and 110. This is shown in FIG. 7 by different angular length of current collectors 106, 108, and 110.

FIGS. 6 and 7—Operation of the Embodiment of the Invention with Three Different Lamps and Motor Rotating with Constant Speed As the electric motor 100 rotates with a constant speed, the current collectors 106, 108, and 110 are sequentially connected via the angularly and axially displaced current collectors 106, 108, and 110 and their sliding contacts 106*a*, 108*a*, and 110*a* to the terminal 128 of the main power supply S. Since the current collectors 106, 108, and 110 are permanently electrically connected via the current collecting bus 130 and ring 114, with the sliding contact 114*a*, to the terminal 120 of the main power source S, lamps 74, 76, and 78 will be sequentially lit and illuminate an appropriate transparent colored visual indicator, such as the green duration indicator 24 shown in FIG. 1. Since current collectors 106, 108, and 110 are angularly shifted, the lamps will be lit one at a time for a duration proportional to the angular length of the respective current collector 106, 108, and 110.

Figure 8:
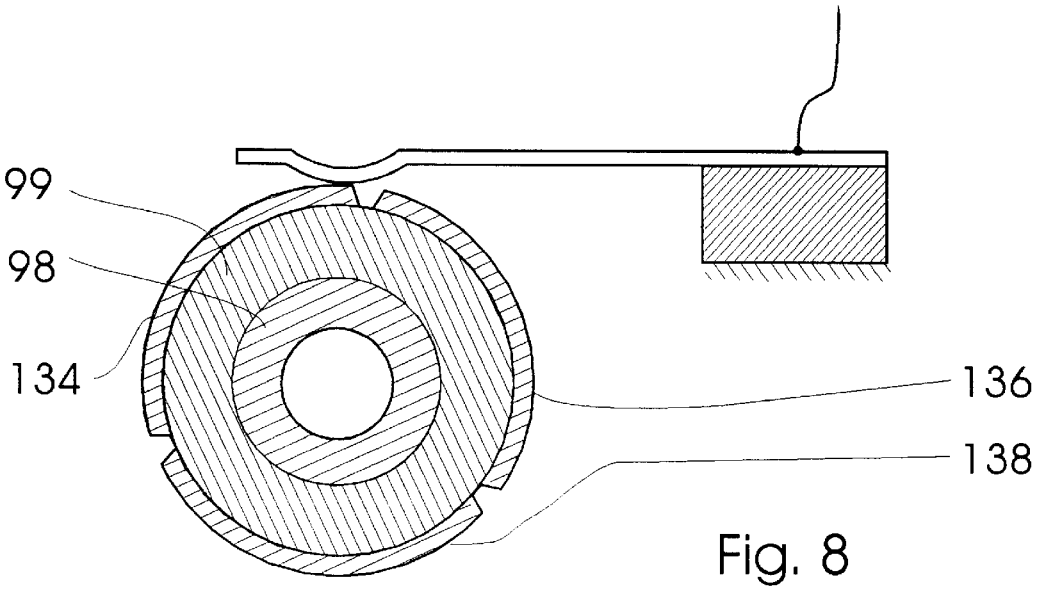
FIG. 8 is a side view similar to FIG. 7 for an embodiment of the device of the invention with the drum rotating from a stepper motor which receives control and clock signals from a traffic control system.
Figure 9:
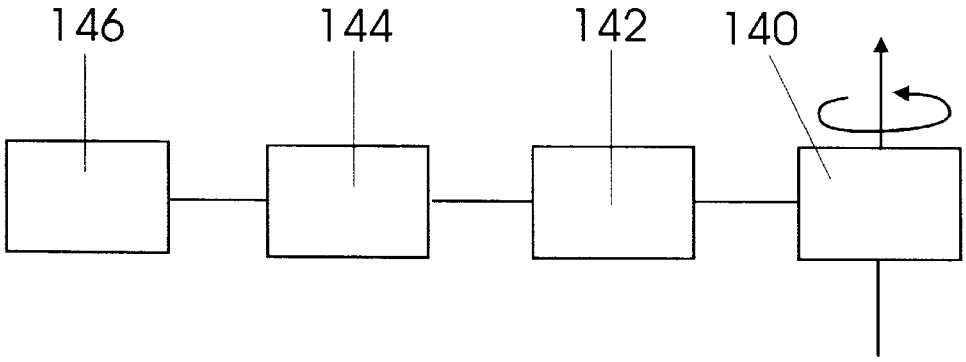
FIG. 9 is a block diagram of a motor control system for the embodiment of FIG. 8.
Figure 10:
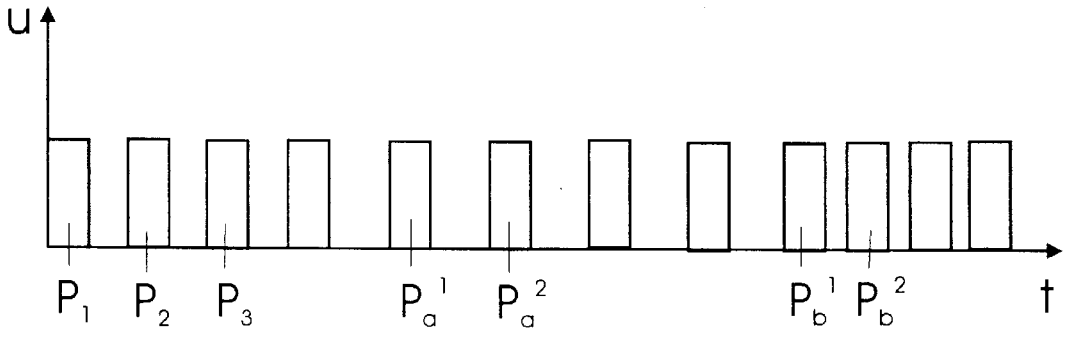
FIG. 10 illustrates a sequence of clock signals of different duration for accelerating rotation of the stepper motor during indication of the yellow signal which is illuminated for a shorter time than the green and red visual indicators.

FIGS. 8, 9, and 10—Embodiment of the Attachment of the Invention with Three Lamps and a Drum Driven from a Stepper Motor Since in the device of this embodiment, the construction of the drum, arrangement of the lamps, and connection of the drum hub to the motor is the same as in FIGS. 3, 4, 6, their description and illustration are omitted, and the same reference numerals as defined above will be used. FIG. 8 is a side view similar to FIG. 7 for an embodiment of the device of the invention with the drum 90 rotating from a stepper motor 132 shown in FIG. 9 which is a block diagram of a motor control system for the embodiment of FIGS. 8, 9, and 10.

As shown in FIG. 8, current collectors 134, 136, and 138, which are supported by the sleeve 99 on the hub 98 of the rotating drum 90 have equal angular lengths, and the duration of respective traffic light signal depends on the speed of rotation of the stepper motor 140 (FIG. 9). As shown in FIG. 9, stepper motor 140 is connected in series with a power supply unit 142, a power supply controller 144, and a traffic controller 146. The aforementioned power supply unit 142 and the power supply controller 146 are standard units commercially produced by . . . (see Model . . . ). The power supply unit 142 generates a series of pulses for controlling speed of rotation of the stepper motor 140 in the form of a pulse train shown in FIG. 10. FIG. 10 illustrates a sequence of clock signals P1, P2, . . . of different duration for accelerating rotation of the stepper motor during indication of the yellow signal which is lit for a shorter time than the green and red visual indicators controlled by signals Pa1, Pa2 . . . , and Pb1, Pb2 . . . , respectively.

It can be seen, that the speed of rotation of the stepper motor 140 depends on the time intervals between the sequences of pulses P1, P2 . . . in the pulse train.

The assembly consisting of the power supply controller 144 and the power supply unit 142 operates under the control of clock signals obtained from the traffic controller 146. Such clock signals are required for synchronizing the operation of the stepper motor 140, and hence of the visual indicator of the traffic light signal duration, with the actual timing of the traffic lights. Normally, the timing of a plurality of traffic lights at a plurality of intersections with a variety of timing patterns is controlled by means of a traffic control system. One such system is described, e.g., in U.S. Pat. No. 4,257,029 issued in 1981 to C. Stevens. Such a traffic control system has a master controller which is connected to an intersection controller. The latter consists of an interconnection circuit which is connected in parallel with a multiplex memory, a basic timer, and an output switch. An output signal of this output switch has an output signals STC (FIG. 9) which control the operation of the traffic light 20 (FIG. 1A) and at the same time synchronously controls operation of power supply controller 144 of the attachment 22 of the invention.

FIGS. 8, 9, and 10—Operation of the Embodiment with the Drum Driven from a Stepper Motor The attachment of the embodiment of FIGS. 8, 9, and 10 with rotating drum 90 driven from the stepper motor 140 operates as follows. An output signal STC is supplied via the power supply controller 144 and the power supply 142 to a stepper motor in the form of a train of pulse signals P1, P2, . . . (FIG. 10) with different time intervals between the pulse signals for controlling the speed of rotation of the stepper motor 140 in synchronism with the switching of the traffic light signals in the traffic light unit 20 (FIG. 1A).

As the stepper motor 140 rotates with the speed determined by the pulse signals P1, P2, . . . , current collectors 134, 136, and 138 are sequentially connected via current collectors and their sliding contacts (only one of which 108*a* is shown in FIG. 8) to terminal 128 of the main power supply S (FIG. 6). Since current collectors 134, 136, and 138 are permanently electrically connected via current collecting bus 130 and ring 114 of the type shown in FIG. 6 with sliding contact 114*a*, to terminal 120 of the main power source S, lamps 74, 76, and 78 will be sequentially lit and illuminate an appropriate transparent colored visual indicator, such as the green duration indicator 24 shown in FIG. 1. Since current collectors 106, 108, and 110 are angularly shifted, the lamps will be lit one at a time for a duration proportional to the duration of pulses in sequential pulse trains T1, T2, and T3 shown in FIG. 10.

Figure 11:
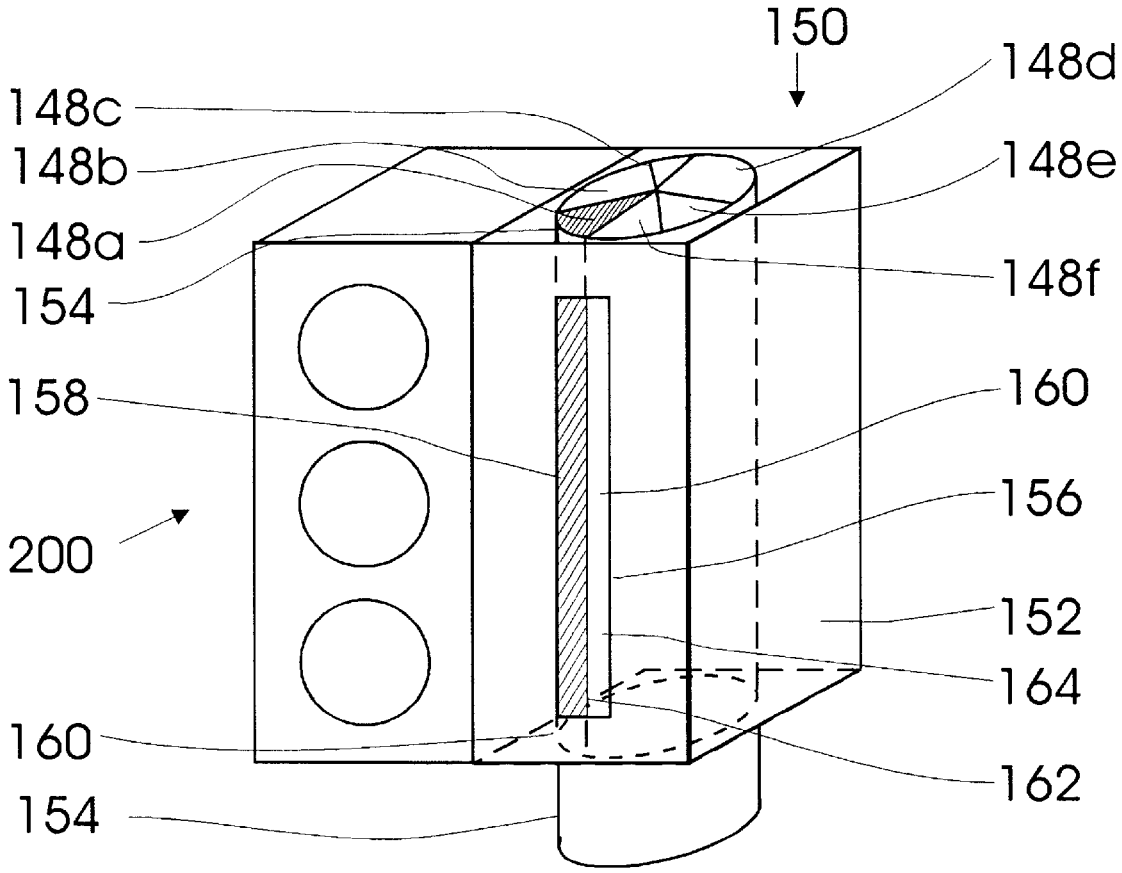
FIG. 11 is an embodiment of the invention with a vertically arranged drum having the light indicator in the form of a vertical rectangular stripe of a width variable in proportion to the time remaining till switching of the traffic lights.
Figure 12:
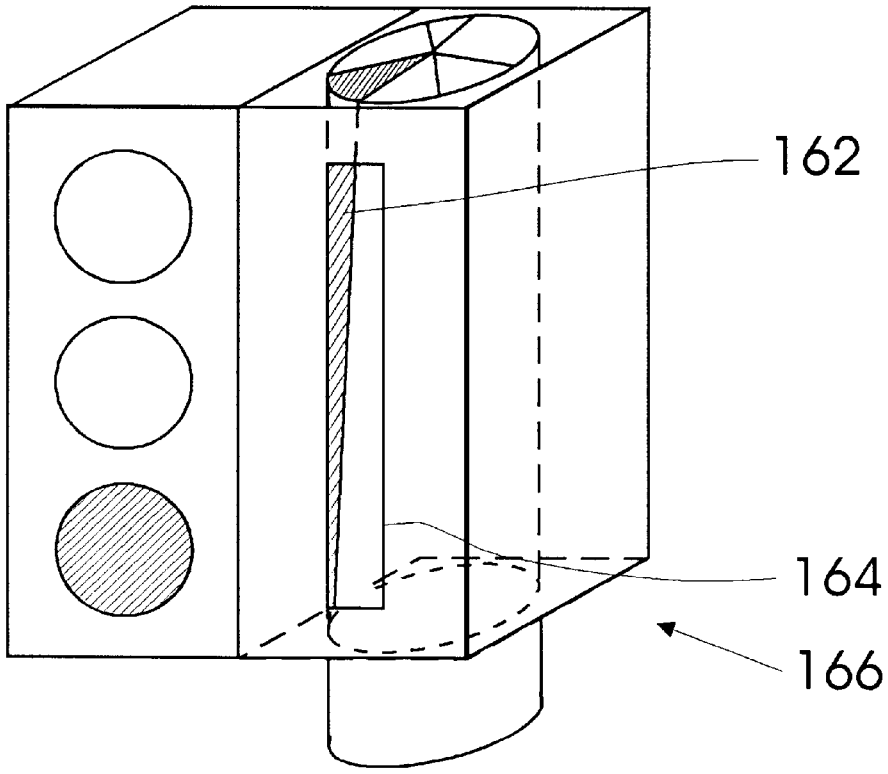
FIG. 12 is a view similar to FIG. 11 for an embodiment with a vertical wedge-like visual indicator.

FIGS. 11 and 12—Embodiments of the Invention with a Vertically Arranged Drum FIGS. 11 illustrates an embodiment of the invention with a vertically arranged rotating drum 148. A device of the invention, which in general is designated by reference numeral 150 is connected to a side wall of a traffic light unit 20 and has a rectangular housing 152 which rotationally supports the vertically arranged drum 148 driven from an electric motor 154. The drive unit and electric circuitry for this embodiment are not shown, since they can be the same as those described in the previous embodiments. In other words, the drum can be rotated from a motor with a constant speed or from a stepper motor. The interior of the drum 148 is divided by nontransparent partitions into three sections 148*a*, 148*b*, and 148*c*. The entire arrangements with a single or three lamps, as well as the electrical connections, current collectors, as well as all other features and principle of operation of the invention described above are applicable to this embodiment as well. The only difference is that the time remaining before switching to the traffic light of another color is proportional to the width of the currently lighted stripe shown in the window 156. As the width of the colored illuminated stripe, such as stripe 158 shown in FIG. 11 and defined by section 148*a*, is reduced, the width of next stripe 160, which at the current moment is not yet illuminated, is increased. At the moment when the illuminated stripe 158, which may be, e.g., a green stripe, completely disappears and is completely replaced by the next, e.g., the yellow stripe 160, the aforementioned electrical control system, described with reference to FIG. 9, will switch the traffic light so that the lamp inside the green sector will be switched off and the lamp of the yellow sector will be switched on. Then the cycle will be repeated between the yellow and the red traffic light signals.

FIG. 12 is a view similar to FIG. 11 for an embodiment with a vertical wedge-like visual indicator. The construction and principle of operation of the device of this embodiment is the same as those of the embodiment of FIG. 11, with the exception that a wedge-like visual indicator 162, similar to the wedge 24 of FIG. 1A, will be seen through a window 164 of the attachment 166 of the invention.

Figure 13:
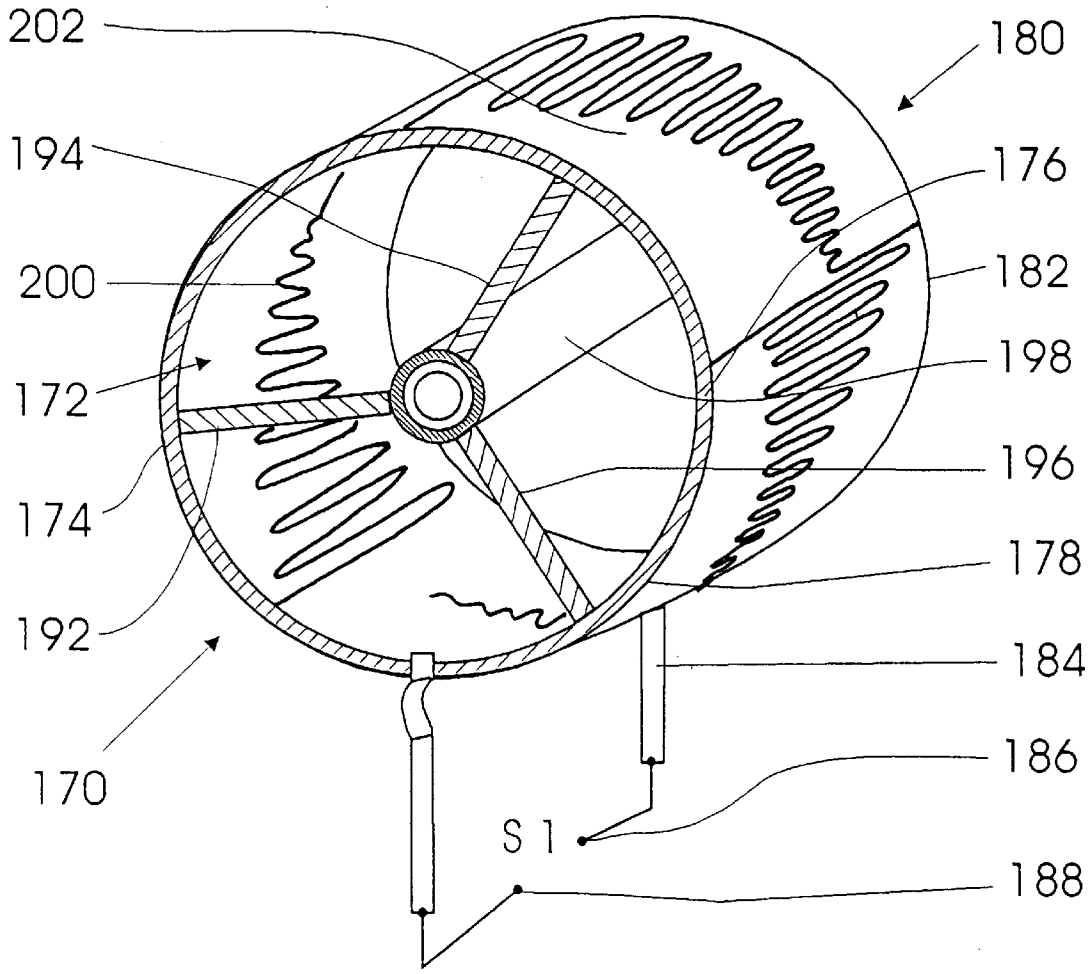
FIG. 13 is a three-dimensional view of the rotating drum without nontransparent partitions and without current collectors on the shaft of the motor.

FIG. 13—An Embodiment of the Invention without Non-transparent Partitions

The device of the invention can be significantly simplified if a rotating drum 170 is made in accordance with the three-dimensional view shown in FIG. 13. More specifically, the rotating drum 170 comprises a cylindrical body made of a nonconductive material, e.g., strong plastic which supports on its front end face 172 three arch-shaped conductive current collectors 174, and 178. If the device of the invention is made in accordance with the embodiment utilizing a motor (not shown in FIG. 13) that rotates with a constant speed, the angular length of current collectors 174, 176, and 178 will correspond to the duration of an appropriate traffic signal. The rear end face 180 of drum 170 supports a current collecting metal ring 182 which is in a constant sliding contact with a spring-loaded contact 184 which is permanently connected to a terminal 186 of a main power source S1. The second terminal 188 of the power source S1 is connected to a spring-loaded sliding contact 190 (of the same type as contact 108*a* in FIG. 8) which slides over the end face 172 of the drum and sequentially comes into contact with current collectors 174, 176, and 178.

Spikes 192, 194 and 196 support the drum 170 on a sleeve 198 which is attached to the output shaft of the motor (not shown).

Each wedge-like colored visual indicator, such as indicator 24 in FIG. 1A, is formed by a serpentine-like gas-discharge lamp which is laid onto the cylindrical surface of the drum 170 and has a plurality of coils of a gradually decreasing width so that a triangular shape is formed if such a lamp is developed onto a flat surface. Thus, three wedge-like gas-discharge lamps 200, 202, and 204 are formed, and each lamp is lit in a different color, i.e., green, yellow, and red, respectively. The output terminals of each lamp are connected respectively to the metal ring 182 on the rear end face 180 of the drum and to a respective current collector 174, 176, and 178 on the from end face 172 of the drum.

In operation, when the drum 170 rotates, the lamps are sequentially lit when the sliding contact 190 slides over the current collectors 174, 176, and 178 corresponding to these lamps. The electrical control and synchronization of traffic light and light indicator switching operations can be carried out in accordance with the circuitry and procedures described above.

FIGS. 14, 15, 16, and 17—Embodiment of the Invention with Regard to a Traffic Light Having Four Signals on All Four Sides of the Traffic Light Apparatus (Construction and Operation)

The embodiments described above were illustrated in conjunction with traffic light apparatuses having only three traffic light signals and only on one side of the apparatus. Although such traffic lights correspond to a majority of cases and are normally installed on the corners of the intersections, some intersections have four sided traffic lights suspended above the centers of the intersections. Moreover, such traffic lights often have four traffic light signals on each side of the apparatus, i.e., "green", "yellow", "red" and "arrow".

Figure 14:
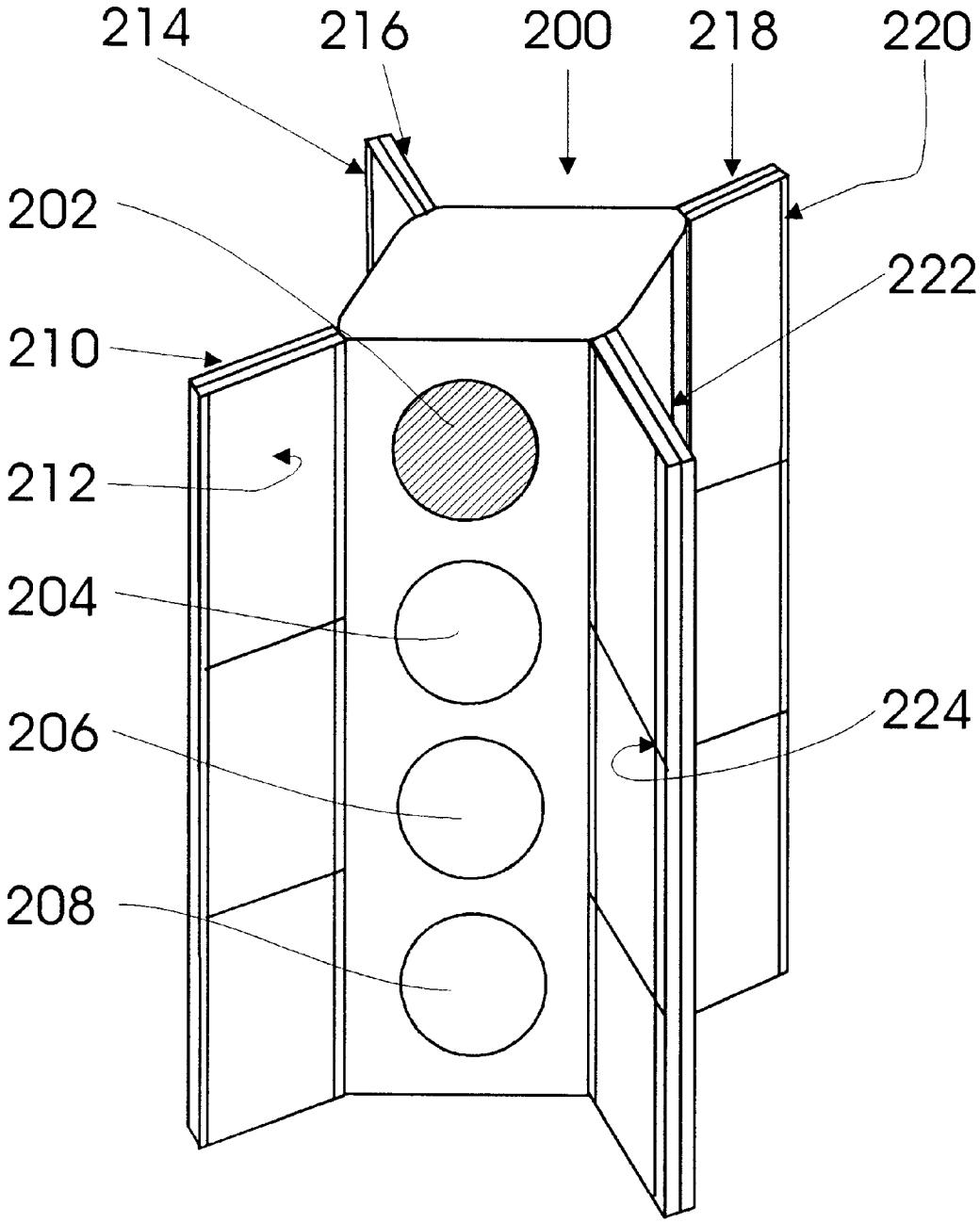
FIG. 14 is a three-dimensional view of the attachment of the invention in conjunction with a four-sided traffic light apparatus.

FIG. 14 is a three-dimensional view of device of the invention in conjunction with a traffic light apparatus having four signals on each side of the apparatus. As shown in FIG. 14, the apparatus 200 of this embodiment has four traffic light signals on each side. Only four such signals are seen in FIG. 14, i.e., a signal 202 which corresponds to "red", a signal 204 which corresponds to "yellow", a signal 206 which corresponds to "green", and signals 208 which corresponds to "arrow".

Reference numerals 210, 212, 214, 216, 218, 220, 222, and 224 designate visual indicator panels of the invention for indicating the time remaining for switching of the current traffic light signal. In order to improve visibility of the visual signal and to shade the panel from the effect of the adjacent panel that indicates a figure of a different color, two panels, e.g., such as panels 212 and 224, operate simultaneously and are arranged on both corners on one side of a traffic light apparatus 200 so that two indicator signals can be seen at the same time with the current traffic light signal of the same color from the side of the traffic moving in one direction. It can be seen that the panels are combined in pairs in a back to back relationship to each other. More specifically, panels are connected back to back in pairs to form two-sided display panels. The following panels are paired: 210 and 212; 214 and 216; 218 and 220; and 222 and 224.

It is understood that when the panels 210 and 214 show a green figure of a variable width as an indicator of the time remaining to switching, the panels 216 and 218 show a red figure for the drivers of the vehicles moving in the direction perpendicular to those looking at the traffic lights 202–208.

Figure 15:
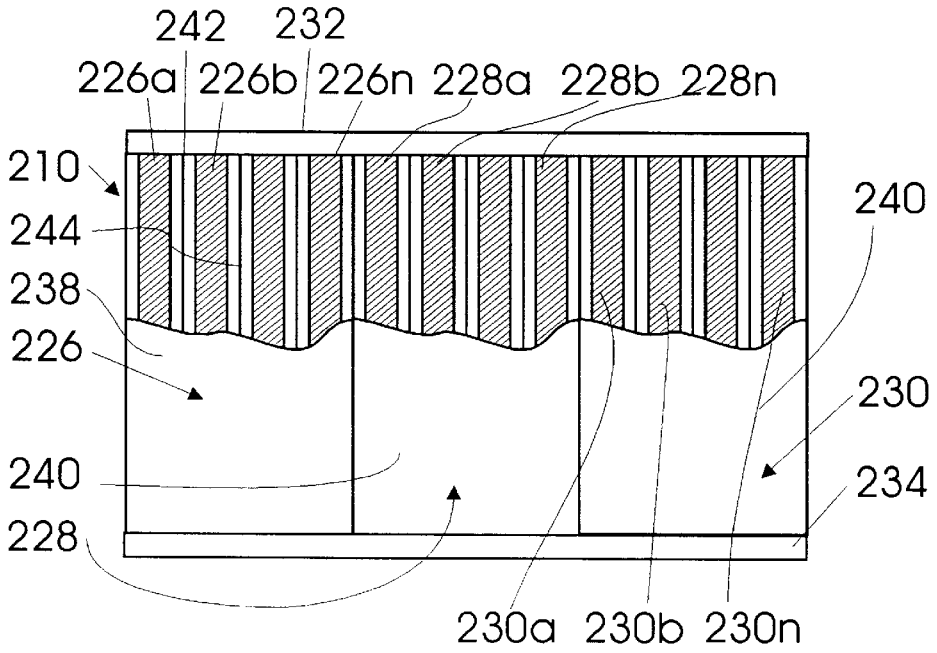
FIG. 15 is a front view of a display according to another embodiment of the invention in which the display is formed by a plurality of parallel gas-discharge lamps switched on and off under control of an electric circuit.

Since all the panels have the same construction, only one of them will be described in detail. One such panels, e.g., panel 210 is shown in FIG. 15. The panels 210 is divided into three sections 226, 228, and 230. Each section is formed by a plurality of gas-discharge lamps arranged parallel to each other in a vertical direction between two frame supports 232 and 234. In other words, section 226 is formed by lamps 226*a*, 226*b*, . . . 226*n*; section 228 is formed by gas-discharge lamps 228*a*, 228*b*, . . . 228*n*; and section 230 is formed by luminescent lamps 230*a*, 230*b*, . . . 230*n*. From the outside of the lamps, each section is covered by a glass of an appropriate color; red, green, or yellow. For example, section 226 is covered by a green glass 236, section 228 is covered by a yellow glass 238, and section 230 is covered by a red glass 240. In order to exclude propagation of the light from the lamps in a transverse direction, i.e., across the panels, a thin nontransparent partition is inserted between two adjacent lamps. For examples, a partition 242 is installed between lamps 226*a* and 226*b*; a partition 244 is installed between lamps 226*b* and 226*c*, etc.

Figure 16:
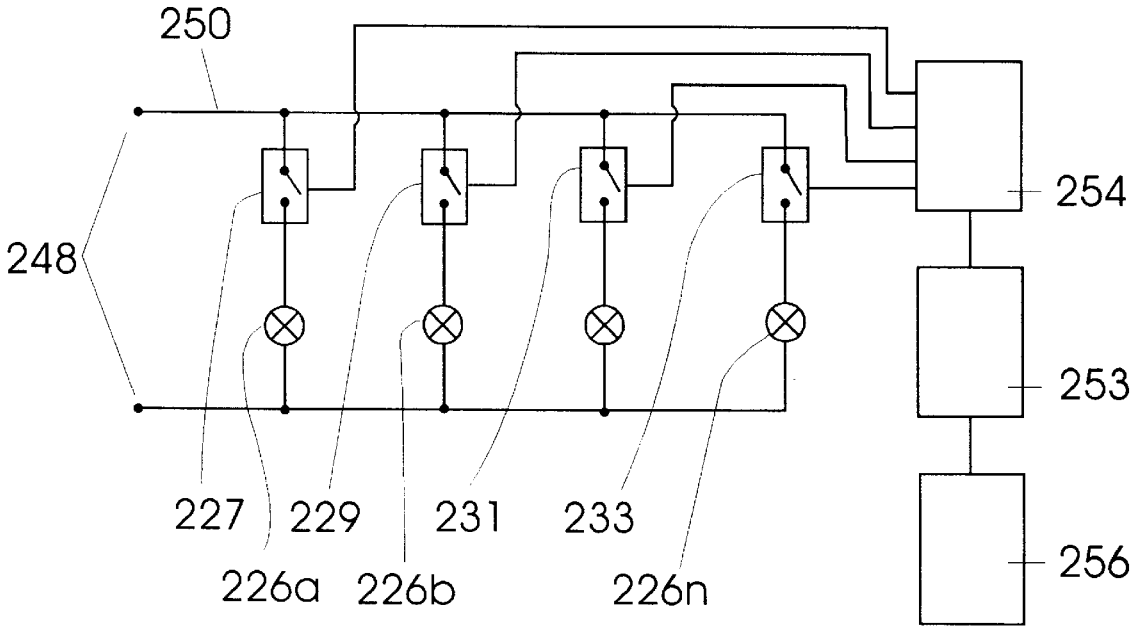
FIG. 16 is an electric diagram of one sector of the panel of FIG. 15.

FIG. 16 is an electric diagram of one sector of the panel, e.g., of the panel 226. The remaining sectors have the same electrical circuits. It can be seen that lamps 226*a*, 226*b*, . . . 226*n* are connected in parallel to each other between a conductor 246 connected to a terminal 248 of a main power supply and a conductor 250 connected to a second terminal 252 of the main power supply. Each lamp is connected to the conductor 250 via individual relays 227, 229, 231 . . . , e.g., mercury displacement relay, such as type KD10-1000-4000 produced by Watlow Co., Richmond, Ill., USA. Each such relay is connected to a microprocessor 254, which, in turn, is connected to a traffic controller 256 of the type described above, in connection with the previous embodiment of the invention, via a central processing unit (CPU) 258.

Figure 17:
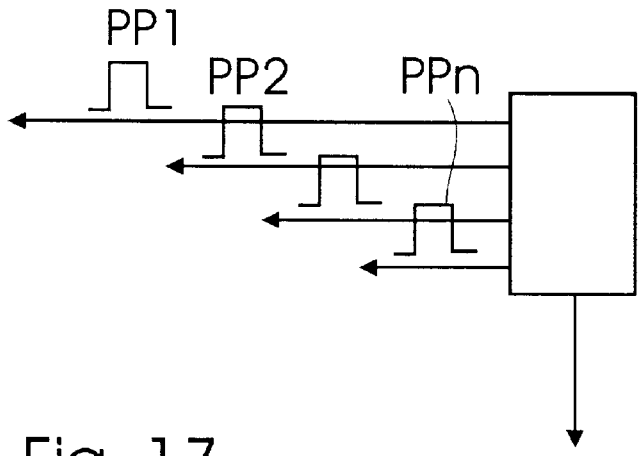
FIG. 17 is a schematic view illustrating a series of pulse signals that control operation of lamps in the display panel of FIG. 16.

The device operates as follow:

In order to illuminate the entire sector, e.g., the green sector 226, all lamps 226*a*, 226*b*, . . . 226*n* are switched on simultaneously, or sequentially via the respective mercury displacement relays 227, 229, 231 by means of a series of pulse signals PP1, PP2 . . . PPN with short time intervals between the pulses, as shown in FIG. 17. These signals are sent to the relays from the microprocessor which operates under control of the traffic controller 256 via the CPU 258. Under the effect of the aforementioned control, the lamps 226*a*, 226*b*, . . . 226*n* of the green sector 226 are switched off in sequence in proportion with the time left before switching of the current green traffic light signal to yellow. When the last lamp of the sector is switched off, the CPU 258 sends a command to the relay of the next, i.e., yellow panel 228, for simultaneous or quick sequential illumination of the lamps in the sector 228, and so on.

Figure 18:
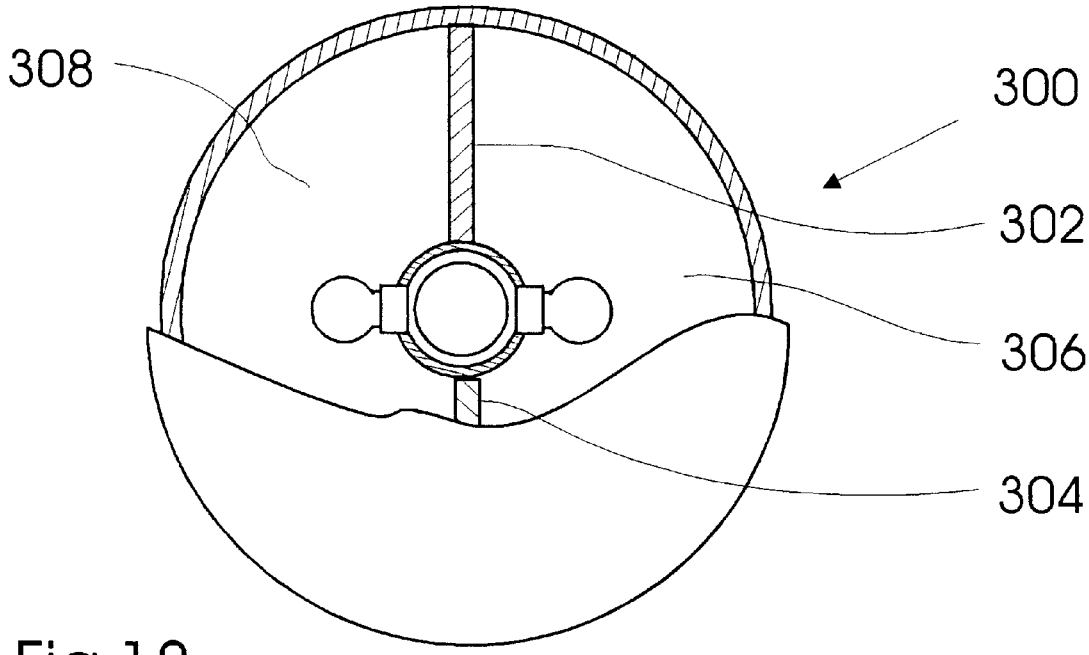
FIG. 18 is a view similar to FIG. 5 illustrating the arrangement of nontransparent partitions inside the rotating drum with two sectors and two individual lamps.
Figure 19:
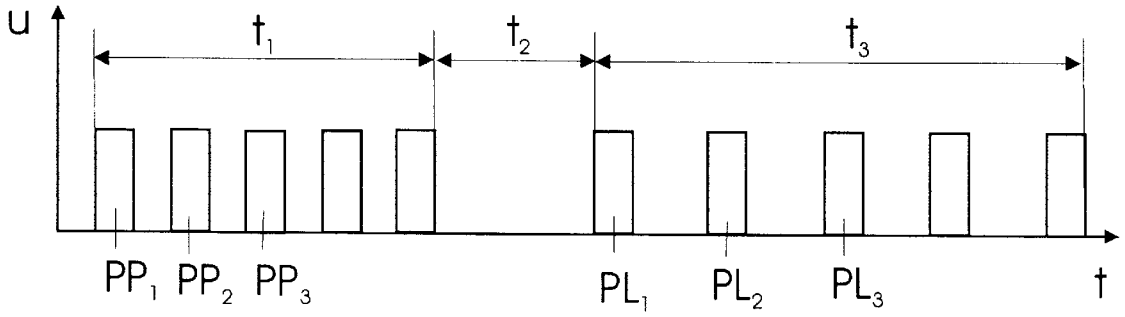
FIG. 19 is a schematic view illustrating a series of pulse signals that control operation of lamps in the display panel of the device of FIG. 18.

FIGS. 18 and 19—Embodiment of the Invention with two Sectors and Two Individual Lamps Since the "yellow" traffic signal is lit only for a relatively short period of time, it may be expedient to show on the display only red and green visual indicators of the time left till switching to the next light signal, and not to show the yellow indicator.

Such an apparatus, in principle, will have the same construction and will operate in the same manner as those described above in connection with a three-sector drum or a three-color indicator. Therefore, a detailed description of such an embodiment will be omitted.

FIG. 18 is a view similar to FIG. 5 illustrating the arrangement of nontransparent partitions inside the rotating drum with two sectors and two individual lamps, and FIG. 19 is a schematic view illustrating a series of pulse signals that control operation of lamps in the display panel of the device of FIG. 18.

More specifically, a rotating drum 300 is divided by nontransparent partitions 302 and 304 into two sectors 306 and 308, one for a green color indicator and another for a red color indicator. The indicators may have the same images (triangular or rectangular) as has been described above and may be applied onto the surface of appropriate cylindrical portions of the drum.

The drum 300 is driven into rotation by a stepper motor under control of a system shown in FIG. 9. In other words, the stepper motor 140 is connected in series with a power supply unit 142, a power supply controller 144, and a traffic controller 146. The power supply unit 142 generates a series of pulses for controlling speed of rotation of the stepper motor 140 in the form of a pulse train shown in FIG. 19. FIG. 10 illustrates a sequence of clock signals. Period $t_1$ with pulses PP1, PP2, . . . corresponds to the green traffic light signal, period $t_2$ without generation of pulses corresponds to the yellow traffic light signal, and period $t_3$ with pulses PL1, PL2 . . . corresponds to the red traffic light signal. It is understood that the stepper motor 140 will rotate the drum 300 only during periods $t_1$ and $t_3$ and will not rotate the drum 300 during the yellow signal.

Thus it has been shown the invention provides a simple, reliable, clearly understandable visual traffic light duration indicator that can be attached to any existing traffic light assembly without necessity of essentially changing its construction. It has also been shown that the invention provides a visual traffic light duration indicator which does not cause confusion, inexpensive to manufacture, does not limit driving ability, and does not distract a driver's attention.

Although the invention has been shown and described with reference to several specific embodiments, it is understood that these embodiments should not be construed as limiting the application of the invention and that any modifications with regard to shape, materials, and construction elements and units are possible, provided they are within the scope of the patent claims. For example, sheets of gas-discharge materials can be used instead of coiled gas-discharge lamps, or colored lamps can be used instead of colored transparent visual indicators. The drive motor can be located in a different position and transmit movements through gears. The visual color indicator of the time remaining to switching of the traffic signal to the next signal can be made in the form of a plasma display with a plurality of gas-discharge cells instead of a plurality of gas-discharge lamps. At the present time such displays find growing application and are capable of providing a very bright image on the screen of the display. Examples of such plasma displays are devices described, e.g., in U.S. Pat. No. 5,231,382 issued to A. Tanaka in 1983, or U.S. Pat. No. 5,841,232 issued to K. Hirao, et al. in 1998. The device of the invention may be located near the traffic light apparatus and may not be physically connected to this apparatus. The visual display image may be monochromatic.

What is claimed is:

1. An attachment to a traffic light apparatus for visual indication of current traffic light signal duration comprising:

a stationary housing which contains display means for reproducing a visual image with the surface area being reduced substantially in proportion with the time remaining till switching of said current traffic light signal to another traffic light signal;

wherein said housing has a window seen simultaneously with said current traffic light signal, and wherein said display means comprises:

a drum having a hub portion, a cylindrical peripheral surface, and radial nontransparent partitions which divide the interior of said drum at least into two angular sectors;

means for rotatingly supporting said drum in said stationary housing;

illumination means attached to a stationary part of said stationary housing so that said illumination means remains stationary as said drum rotates;

said angular sectors having peripheral surfaces formed by portions of said cylindrical peripheral surface, said peripheral surfaces of said angular sectors having transparent portions of different colors corresponding to the colors of said traffic light signals, said visual image being formed by said transparent portions and is illuminated by said illumination means; and means for rotating said drum so that said visual image is seen through said window with the surface area gradually decreasing substantially in proportion with the time remaining till switching of said current traffic light signal to the next traffic light signal, so that at the moment of switching of said current traffic light signal said surface area of said visual image becomes equal to zero while the visual image of a color corresponding to the next traffic signal appears in said window in its full size.

2. The attachment of claim 1, wherein said visual image has the same color as said current traffic light signal.

3. The attachment of claim 2, wherein said housing has a window seen simultaneously with said current traffic light signal, and wherein said display means comprises:

a drum having a hub portion, a cylindrical peripheral surface, and radial nontransparent partitions which divide the interior of said drum at least into two angular sectors;

means for rotatingly supporting said drum in said stationary housing;

individual illumination means in each said angular sector attached to said drum for rotating therewith;

said angular sectors having peripheral surfaces formed by portions of said cylindrical peripheral surface, said peripheral surfaces of said angular sectors having transparent portions of different colors corresponding to the colors of said traffic light signals, said visual image being formed by said transparent portions and are illuminated by said illumination means;

means for switching said individual illumination means on and off in synchronism with switching of said traffic light signals; and means for rotating said drum so that said visual image is seen through said window with the surface area gradually decreasing substantially in proportion with the time remaining till switching of said current traffic light signal to the next traffic light signal, so that at the moment of switching of said current traffic light signal to the next traffic light signal said surface area of said visual image becomes equal to zero while the visual image of color corresponding to the next traffic signal appears in said window in its full size.

4. The attachment of claim 3, wherein said means for rotatingly supporting said drum in said stationary housing comprises a stationary shaft attached to said housing and rotatingly supporting said hub; said means for rotating said drum comprising an electric motor of a constant speed, said peripheral surfaces of said angular sectors having angular lengths proportional to the duration of traffic light signals the color of which corresponds to the colors of respective visual displays.

5. The attachment of claim 4, where said drum is divided by said nontransparent partitions into three angular sectors, said attachment further comprising an electric circuit having a main power supply with a first terminal and a second terminal; said electric motor having an output shaft which rigidly supports said hub and five current collectors, three of which are connected to said first terminal of said main power supply by individual conductors each of which is connected to one of said individual illumination means, the fourth current collector being connected to said three current collectors and to said second terminals of said main power supply and a fifth current collector being constantly connected to said first terminal and said individual illumination means, the angular length of said three current collectors being proportional to the angular length of said peripheral surfaces of said angular sectors and to the duration of traffic light signals the color of which corresponds to the colors of respective visual displays.

6. The attachment of claim 5, wherein said visual image has a triangular shape so that as the drum rotates an illuminated triangular figure of the same color as the current traffic light signal is seen through said window.

7. The attachment of claim 5, wherein said visual image has a rectangular shape so that as the drum rotates an illuminated rectangular figure of the same color as the current traffic light signal is seen through said window.

8. The attachment of claim 3, wherein said means for rotatingly supporting said drum in said stationary housing comprises a stationary shaft attached to said housing and rotatingly supporting said hub; said means for rotating said drum comprising an electric stepper motor.

9. The attachment of claim 8, further comprising a control circuit comprising: a power supply unit, an output of which is connected to said pulse motor; a controller for controlling operation of said power supply unit, an output of said controller being connected to said power supply unit; and a main traffic controller which controls operation of said attachment in synchronism with the operation of said traffic light apparatus.

10. The attachment of claim 9, further comprising an electric circuit having a main power supply with a first terminal and a second terminal; said electric motor having an output shaft which rigidly supports said hub and five current collectors, three of which are connected to said first terminal of said main power supply by individual conductors each of which is connected to one of said individual illumination means, the fourth current collector being connected to said three current collectors and to said second terminals of said main power supply and a fifth current collector being constantly connected to said first terminal and said individual illumination means, the speed of rotation of said electric motor being controlled by pulses generated by said power supply unit.

11. The attachment of claim 3, wherein each said individual illumination means comprise gas-discharge lamps in a serpentine form corresponding to said visual image formed by said transparent portions.

12. The attachment of claim 11, wherein said visual image has a triangular shape so that as the drum rotates an illuminated triangular figure of the same color as the current traffic light signal is seen through said window.

13. The attachment of claim 11 wherein said visual image has a rectangular shape so that as the drum rotates an illuminated rectangular figure of the same color as the current traffic light signal is seen through said window.

14. The attachment of claim 11, further provided with a control circuit comprising: a main power supply having a first terminal and a second terminal; a continuous conductive ring on one end face of said drum; a current collector which is in constant sliding electric contact with said continuous conductive ring and which is constantly connected to said first terminal; at least two arch-shaped conductive elements on the other end face of said drum; a second current collector in a constant sliding contact with said other end face of said drum on the path of said at least two arch-shaped conductive elements, each said arch-shaped conductive element being connected to one of said gas-discharge lamps so that when said second current collector is in contact with one of said arch-shaped conductive element, the lamp which is connected to said arch-shaped conductive element is illuminated.

15. The attachment of claim 2, wherein said housing has a vertically arranged window seen simultaneously with said current traffic light signal, and wherein said display means comprises:

a vertically arranged drum having a hub portion, a cylindrical peripheral surface, and radial nontransparent partitions which divide the interior of said drum at least into two angular sectors;

means for rotatingly supporting said drum in said stationary housing;

individual illumination means in each said angular sector attached to said drum for rotating therewith;

said angular sectors having peripheral surfaces formed by portions of said cylindrical peripheral surface, said peripheral surfaces of said angular sectors having transparent portions of different colors corresponding to the colors of said traffic light signals, said visual image being formed by said transparent portions and are illuminated by said illumination means;

means for switching said individual illumination means on and off in synchronism with switching of said traffic light signals; and means for rotating said drum so that said visual image is seen through said window with the surface area gradually decreasing substantially in proportion with the time remaining till switching of said current traffic light signal to the next traffic light signal, so that at the moment of switching of said current traffic light signal to the next traffic light signal said surface area of said visual image becomes equal to zero while the visual image of color corresponding to the next traffic signal appears in said window in its full size, said means for rotatingly supporting said drum in said stationary housing comprising a stationary shaft attached to said housing and rotatingly supporting said hub; said means for rotating said drum comprising an electric motor of a constant speed, said peripheral surfaces of said angular sectors having angular lengths proportional to the duration of traffic light signals the color of which corresponds to the colors of respective visual displays.

16. The attachment of claim 15, where said nontransparent partitions divide said rotating drum into three angular sectors, said attachment further comprising an electric circuit having a main power supply with a first terminal and a second terminal; said electric motor having an output shaft which rigidly supports said hub and five current collectors, three of which are connected to said first terminal of said main power supply by individual conductors each of which is connected to one of said individual illumination means, the fourth current collector being connected to said three current collectors and to said second terminals of said main power supply and a fifth current collector being constantly connected to said first terminal and said individual illumination means, the angular length of said three current collectors being proportional to the angular length of said peripheral surfaces of said angular sectors and to the duration of traffic light signals the colors of which corresponds to the colors of respective visual displays.

17. The attachment of claim 16, wherein said visual image has a triangular shape so that, as the drum rotates, an illuminated triangular figure of the same color as the current traffic light signal is seen through said window.

18. The attachment of claim 16, wherein said visual image has a rectangular shape so that, as the drum rotates, an illuminated rectangular figure of the same color as the current traffic light signal is seen through said window.

19. The attachment of claim 2, wherein said display means is divided at least into two sections, each said section comprising a plurality of tubular lamps arranged side by side and separated by nontransparent partitions, each said section is covered by a transparent colored medium having colors corresponding to the colors of said traffic light signals, said attachment having a control circuit comprising: a main power supply having a first terminal and a second terminal; each said tubular lamp being constantly connected to said first terminal; individual switching means for connecting said lamps to said second terminal; a controller for controlling operation of said individual switching means; a central processing unit connected to said controller; and a main traffic controller for synchronization of switching of said display means with switching of said traffic light signals.

20. The attachment of claim 19, wherein said traffic light apparatus has four sides a rectangular cross section with four comers and has at least three different traffic light signals on each side, said display means comprising panels, two said panels being connected back to back to form two-sided display panels; each such two-sided display panel being installed on each corner of said rectangular cross section in a radial outward direction so as not to block the view of said traffic signals and to be seen simultaneously with said traffic light signals.

21. The attachment of claim 1, wherein each said partitions has an openings for passage of said illumination means during rotation of said drum.

22. The attachment of claim 21, wherein said means for rotatingly supporting said drum in said stationary housing comprises a stationary shaft attached to said housing and rotatingly supporting said hub and rigidly supporting said illumination means; said means for rotating said drum comprising an electric motor of a constant speed, said peripheral surfaces of said angular sectors having angular lengths proportional to the duration of traffic light signals the colors of which correspond to the colors of respective visual displays.

23. The attachment of claim 22, wherein said visual image has a triangular shape so that as the drum rotates an illuminated triangular figure of the same color as the current traffic light signal is seen through said window.

24. The attachment of claim 22, wherein said visual image has a rectangular shape so that as the drum rotates an illuminated rectangular figure of the same color as the current traffic light signal is seen through said window.

25. The attachment of claim 1, wherein said window and said drum are arranged in a vertical direction.

26. The attachment of claim 25, wherein said partitions having opening for passage of said illumination means during rotation of said drum, said means for rotatingly supporting said drum in said stationary housing comprising a stationary shaft attached to said housing and rotatingly supporting said hub and rigidly supporting said illumination means; said means for rotating said drum comprising an electric motor of a constant speed, said peripheral surfaces of said angular sectors having angular lengths proportional to the duration of traffic light signals the color of which corresponds to the colors of respective visual displays.

27. The attachment of claim 26, wherein said visual image has a triangular shape so that as the drum rotates an illuminated triangular figure of the same color as the current traffic light signal is seen through said window.

28. The attachment of claim 26, wherein said visual image has a rectangular shape so that as the drum rotates an illuminated rectangular figure of the same color as the current traffic light signal is seen through said window.

29. The attachment of claim 28, wherein said means for rotatingly supporting said drum in said stationary housing comprises a stationary shaft attached to said housing and rotatingly supporting said hub; said means for rotating said drum comprising an electric stepper motor.

30. The attachment of claim 29, further comprising a control circuit comprising: a power supply unit, an output of which is connected to said pulse motor; a controller for controlling operation of said power supply unit, an output of said controller being connected to said power supply unit; a main traffic controller which controls operation of said attachment in synchronism with the operation of said traffic light apparatus.

31. The attachment of claim 30, further comprising an electric circuit having a main power supply with a first terminal and a second terminal; said electric motor having an output shaft which rigidly supports said hub and five current collectors, three of which are connected to said first terminal of said main power supply by individual conductors each of which is connected to one of said individual illumination means, the fourth current collector being connected to said three current collectors and to said second terminals of said main power supply and a fifth current collector being constantly connected to said first terminal and said individual illumination means, the speed of rotation of said electric motor being controlled by pulses generated by said power supply unit.

* * * * *